United States Patent [19]

West

[11] Patent Number: 4,669,448

[45] Date of Patent: Jun. 2, 1987

[54] INNER DOOR FOR WATER HEATER

[75] Inventor: Eugene L. West, Grand Rapids, Mich.

[73] Assignee: Bradford-White Corporation, Philadelphia, Pa.

[21] Appl. No.: 896,743

[22] Filed: Aug. 14, 1986

[51] Int. Cl.[4] ..... F24H 1/00

[52] U.S. Cl. ..... 126/361; 126/350 R; 126/285 A; 122/17; 122/44 R; 122/13 R; 49/41; 431/249; 220/345

[58] Field of Search ..... 126/361, 367, 368, 350 R, 126/285 A; 122/14, 16, 17, 44 R, 13 R; 219/312, 282, 322, 342; 431/249; 220/345; 49/41

[56] References Cited

U.S. PATENT DOCUMENTS

| | | | |
|---|---|---|---|
| 1,525,503 | 2/1925 | Hauser | 126/361 X |
| 2,923,797 | 2/1960 | Thelen | 126/361 X |
| 3,043,467 | 7/1962 | Schwebel | 126/361 X |
| 3,045,654 | 7/1962 | Dell | 126/361 X |

*Primary Examiner*—Randall L. Green
*Attorney, Agent, or Firm*—Austin R. Miller

[57] ABSTRACT

The present invention provides an inner door for a water heater that is easily slidably mounted on the inside of a heating chamber, without hinges, and that will not fall off and is difficult to remove and which tightly fits against the side wall of the combustion chamber to prevent flame spillage and rollout while also acting as a radiation shield.

5 Claims, 4 Drawing Figures

INNER DOOR FOR WATER HEATER

FIELD OF THE INVENTION

This invention relates to an inner door for a water heater which is slidably mounted on the inside of a side wall of a heating chamber contained within the water heater to close off an access opening in the heating chamber.

Commercial and domestic water heaters generally contain either electric or gas fired burners to generate heat. These burners are commonly placed within a heating or combustion chamber located adjacent to the water tank to effect maximum heat transfer.

The typical burner mechanism, whether electric or gas fired, is simple in design and manufacture. One major reason for this simplicity is dependability. Because of the high temperatures involved, and in many configurations open flame, it is essential that the burner operate properly all of the time. This is not always possible. Therefore, it is highly desirable to include an access opening in the side wall of the heating chamber.

In the event that the burner becomes inoperative, the access opening provides a way in which the burner can be reached for repair and if need be the burner can be removed through this opening. Also, the access opening provides for easy periodic inspection and maintenance of not only the burner mechanism, but other parts of the water heater as well.

While it is desirable to have a functional access opening, it is not desirable for reasons of safety to have the opening uncovered during the operation of the water heater. Thus, the door should cover the access opening while the water heater is in use.

There are several reasons why it is necessary to have a door to cover the access opening. One reason which applies to a gas fired water heater is the potential for flame spillage —the passage of burner flame through the access opening. This can vary with the amount of back pressure exerted from the flue and other factors. Another reason is the potential for gas rich ignition. This occurs when there is an insufficiency in the amount of oxygen needed for combustion. This allows for a build up of gas within the combustion chamber, which can then flow out through the access opening and ignite. Also, a door properly in place discourages tampering with the water heater components contained within the heating chamber.

A door also serves another major purpose other than for safety. In water heaters it is attempted to achieve the greatest efficiency in heat transfer to the water tank. As a result, the heating chamber is constructed in a way to direct the maximum amount of heat to the tank. With an access opening, heat can escape. Thus, it is desirable to close the opening with a door to reflect heat back into the heating chamber.

It has been discovered that current doors are not providing a level of effectiveness that makes water heaters having an access opening safe efficient when in operation. Doors have been known to fall off, sometimes into the combustion chamber. Other doors are manufactured from lightweight materials that are easily crushed or bent. This allows for the door to become either completely inoperative or to have a poor fit against the side wall. Quite often the hinge mechanism on a door is either poorly designed or weakly constructed. The result is that the door can be easily torn off. Thus, water heaters which are provided with these doors tend to be either unsafe or do not maximize efficiency.

OBJECTS OF THE INVENTION

Thus, it is an object of the present invention to provide an inner door for a water heater which is easily installed but difficult to remove that is mounted inside the heating chamber and slides along its side wall.

It is an important object of the present invention to provide an inner door for a water heater which fits tightly against the side wall of the heating chamber to prevent flame spillage and gas rollout from the heating chamber and to serve as a radiation shield so as to increase the efficiency of the water heater.

It is a further important object of the present invention to provide an inner door for a water heater which is not dependent on conventional hinge mechanisms and will not fall off.

SUMMARY OF THE INVENTION

The present invention provides an inner door for a water heater that is easily slidably mounted on the inside of a heating chamber without hinges that will not fall off and is difficult to remove which tightly fits against the side wall of the combustion chamber to prevent flame spillage and rollout while also acting as a radiation shield.

DETAILED DESCRIPTION OF A PREFERRED EMBODIMENT

Figure 1:
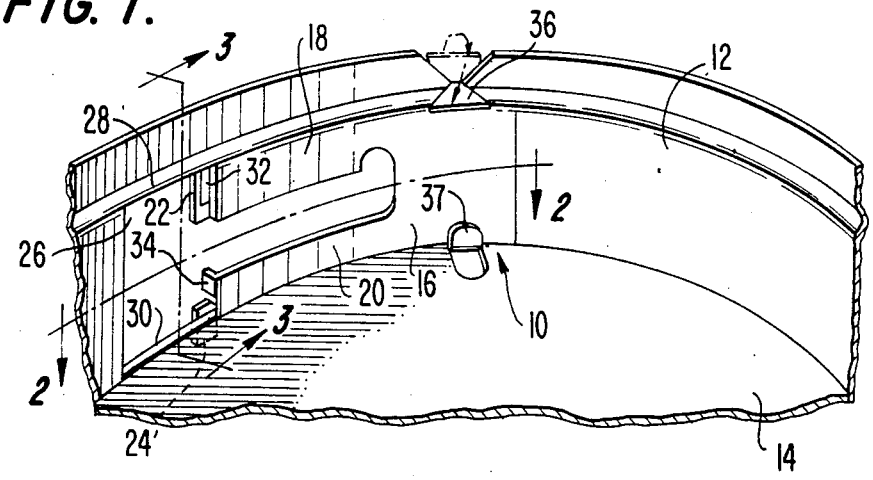
FIG. 1 is a perspective view, partially broken away and shown in section, looking from within the chamber, of one embodiment showing a door as it is mounted in a partially opened position.

Although a specific embodiment of the invention has been selected for illustration in the drawings, and although specific terms will be used in the description which follows, such selection and terms are not intended to limit the scope of the invention, which is defined in the appended claims.

Referring to FIG. 1, the number 10 designates an inner door mounted onto side wall 12 of a heating chamber within a water heater. Inner door 10 slides along the bottom 14 of the water heater. Door 10 is formed by curved plate 16, upper plate portion 18 and lower plate portion 20. Upper arm 22 and lower arm 24 are positioned on the ends of upper plate portion 18 and lower plate portion 20, respectively.

Arms 22 and 24 are used to mount door 10 onto side wall 12. Access opening 26 is provided for easy access to the heating chamber. Access opening 26 has upper edge 28 and lower edge 30 which serve as upper and lower trackways 28 and 30, respectively. Upper and lower trackways 28 and 30 are received into upper slot 32 and lower slot 33 (see FIG. 4), respectively. Upper slot 32 is a gap between upper arm 22 and upper plate portion 18. The lower slot is a gap between lower arm 24 and lower plate portion 20. The width of both gaps must be at least as large as the thickness of side wall 12. This is necessary in order to have enough space for trackways 28 and 30 to be received into upper slot 32 and lower slot 33.

In a preferred embodiment, curved plate 16 and upper and lower arms 22 and 24 are of single piece construction. To form arms 22 and 24, the arms are bent outward toward the convex side of curved plate 16 to a point substantially perpendicular to curved plate 16. Then the vertical arm portion of arms 22 and 24 are bent back substantially parallel to curved plate 16. The result is a "step" shaped pair of bends.

Arms 22 and 24 also serve to restrict the longitudinal sliding movement of door 10 because they pass through access opening 26. Therefore, door 10 can slide over a distance approximating the length of access opening 26. Door 10 is also provided with door opening handle 34 to assist in sliding door 10 back and forth. Tab 36 is cut from side wall 12 and bent inward over door 10 to provide guidance to the sliding action of door 10 when in the open position and to keep door 10 closed positioned adjacent to side wall 12. Also, lance 37 is cut from base pan 14 and bent upward to provide further guidance to door 10 as it slides.

Figure 2:
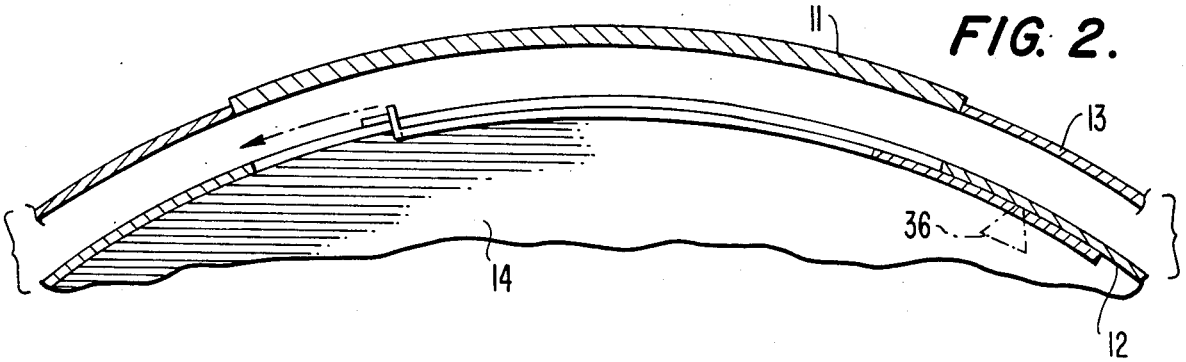
FIG. 2 is a top view of the door, in section, as it is mounted on the inside of the side wall of the chamber in a partially opened position, taken as indicated by the lines and arrows 2—2 which appear in FIG. 1.

FIG. 2 shows door 10 in a partially opened position as it is mounted on side wall 12. Tab 36 is folded inward as in FIG. 1 to keep door 10 adjacent to side wall 12. Door 10 and side wall 12 are spaced apart from jacket 13 which surrounds the heating chamber. An outer door 11 is provided on jacket 13.

Figure 3:
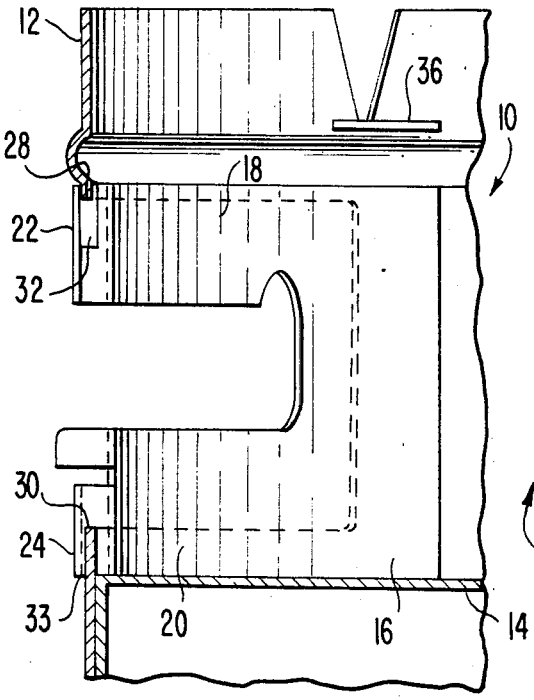
FIG. 3 is another sectional view taken as indicated by the lines and arrows 2—2 which appear in FIG. 1.

Referring to FIG. 3, there is shown door 10 as made from curved plate 16, upper and lower plate portions 18 and 20 and upper and lower arms 22 and 24 as mounted on side wall 12 to slide along bottom 14. Trackways 28 and 30 are received into upper slot 32 and lower slot 33 (see also FIG. 4). Tab 36 is partially bent inward but not over door 10.

It has been discovered that it is highly beneficial to mount door 10 on the inside of side wall 12 instead of the outside. Because upper plate portion 18 overlaps upper edge 28 on the inside, flame spillage and rollout are retarded. Also, fewer door edges are exposed to the exterior. This reduces the chances of door 10 being accidentally or intentionally torn off.

Figure 4:
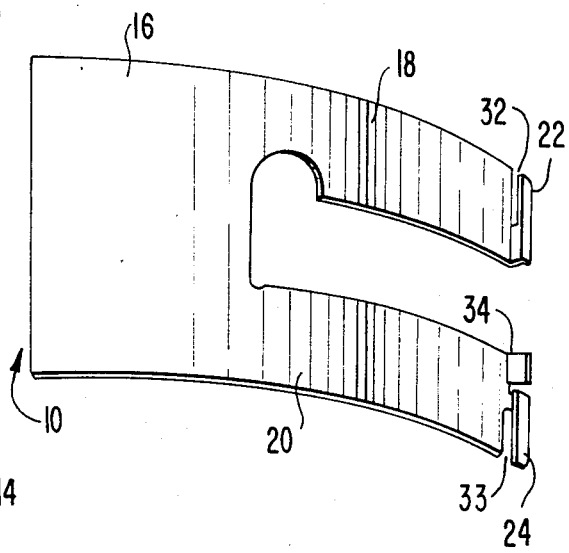
FIG. 4 represents a perspective view of the door of FIG. 1.

FIG. 4 represents door 10 before mounting. Curved plate 16 has upper and lower plate portions 18 and 20, door opening handle 34 and upper and lower arms 22 and 24 as bent into position thereby creating upper and lower gaps 32 and 33 which are ready to receive trackways 28 and 30. Curved plate 16 is preferably made from heavy gauge sheet metal corresponding to side wall 12.

Although this invention has been described in connection with specific forms thereof, it will be appreciated that a wide array of equivalents may be substituted for the specific elements shown and described herein without departing from the spirit and scope of this invention as described in the appended claims.

I claim:

1. A door for a curved heating chamber having an access opening, said chamber being contained within a water heater, said door being slidably mounted on the inside of a curved side wall of said chamber to slide along a bottom portion of said water heater such that said door is snugly positioned against said side wall to restrict flames or excess fuel gas from escaping from said opening in said chamber, said door also acting as a radiation shield to reflect heat back into said chamber, said door comprising:

a curved plate having an opening extending longitudinally therethrough to an open end of said plate, said chamber having an opening providing upper and lower edges forming upper and lower trackways guiding said door for opening and closing movement back and forth along said trackways;

upper mounting means positioned at an upper portion of said open end of said plate, whereby said upper plate portion can be slidably engaged with said upper trackway of said side wall;

lower mounting means positioned at a lower portion of said open end of said plate, whereby said lower plate portion can be slidably engaged with said lower trackway of said side wall, and door opening means included on said door to facilitate opening and closing movement of said door.

2. A door as defined in claim 1 wherein said upper mounting means comprises an upper arm positioned on the end of said upper portion to form an upper slot having a width greater than the thickness of said side wall, said upper arm being angled away from said plate thereby allowing said upper trackway to be received into said upper slot such that a portion of said upper arm is slidably engaged with the outside of said side wall.

3. A door as defined in claim 1 wherein said lower mounting means comprises a lower arm positioned on the end of said lower portion to form a lower slot having a width greater than the thickness of said side wall, said lower arm being angled away from said plate, thereby allowing said lower trackway to be received into said lower slot such that a portion of said lower arm is slidably engaged with the outside of said side wall.

4. A door as defined in claim 1 wherein said plate, said upper mounting means and said lower mounting means are all of a single piece construction.

5. A door as defined in claim 1 wherein said upper and lower mounting means limits the longitudinal movement of said door.

* * * * *